US006854243B2

(12) United States Patent
Sendo et al.

(10) Patent No.: US 6,854,243 B2
(45) Date of Patent: Feb. 15, 2005

(54) PACKAGING MATERIAL FOLDING DEVICE OF PACKAGING MACHINE

(75) Inventors: Makoto Sendo, Tokyo (JP); Tatsuya Ito, Tokyo (JP)

(73) Assignee: Japan Tobacco Inc., Toyko (JP)

( * ) Notice: Subject to any disclaimer, the term of this patent is extended or adjusted under 35 U.S.C. 154(b) by 0 days.

(21) Appl. No.: 10/381,709

(22) PCT Filed: Sep. 12, 2001

(86) PCT No.: PCT/JP01/07911

§ 371 (c)(1),
(2), (4) Date: Mar. 27, 2003

(87) PCT Pub. No.: WO02/26563

PCT Pub. Date: Apr. 4, 2002

(65) Prior Publication Data

US 2004/0011002 A1 Jan. 22, 2004

(51) Int. Cl.[7] ..... B65B 11/28
(52) U.S. Cl. ..... 53/234
(58) Field of Search ..... 53/228–234

(56) References Cited

U.S. PATENT DOCUMENTS 2,609,646 A * 9/1952 Total ..... 53/230
3,372,526 A * 3/1968 Anderson ..... 53/230
3,810,314 A * 5/1974 Anderson ..... 53/230
4,999,970 A * 3/1991 Bamrungbhuet et al. ..... 53/234
5,613,344 A * 3/1997 Osti et al. ..... 53/234

FOREIGN PATENT DOCUMENTS

JP 52-134100 A 11/1977
JP 5-310210 A 11/1993

* cited by examiner

*Primary Examiner*—Stephen F. Gerrity
(74) *Attorney, Agent, or Firm*—Birch, Stewart, Kolasch & Birch, LLP

(57) ABSTRACT

A wrapper folding apparatus of a packaging machine has a second wheel (10) for use as a folding turret. The second wheel (10) is supplied with a cigarette bundle and an aluminized sheet (S) in an inlet position. As this is done, the aluminized sheet (S) is folded around the periphery of the cigarette bundle, and lug portions formed by the peripheral folding are folded by the use of primary lug folding guides (36). Since the lug protions are kept folded by the use of holding guides (38) thereafter, they cannot be freed until an outlet position is reached. When the cigarette bundle is discharged in the outlet position of the second wheel (10), the lug portions on the end-flap side are folded by the use of secondary lug folding guides (46). After the folding, side flaps continue to be folded without allowing the lug portions to be free.

8 Claims, 7 Drawing Sheets

PACKAGING MATERIAL FOLDING DEVICE OF PACKAGING MACHINE

This application is the national phase under 35 U.S.C. § 371 of PCT International Application No. PCT/JP01/07911 which has an International filing date of Sep. 12, 2001, which designated the United States of America.

TECHNICAL FIELD

The present invention relates to a wrapper folding apparatus for folding a wrapper around a product in a fold-packaging machine.

BACKGROUND ART

Articles such as cigarettes and filter cigarettes are packaged in a bundle based on a given number. Conventionally, this packet includes inside packaging for maintaining the flavor quality of cigarettes and outside packaging for externally indicating the cigarette brand and the like. A cigarette packet, having undergone the inside packaging and outside packaging, is further externally wrapped in a covering film. A material that is formed of paper laminated with metal foil, such as tin foil or aluminum foil, having high quality maintaining function can be suitably used as the inner wrapper in which a cigarette bundle is to be wrapped. The material having the metal foil is so flexible that it can be folded with ease. After the material is folded, the material can naturally maintain its folded state.

Conventionally, therefore, a cigarette packaging machine uses a step of folding the inner wrapper, the step utilizing the properties of metal foil. After the inner wrapper is wound around the periphery of a cigarette bundle, in the cigarette packaging machine, movable folding claws are caused to advance into to-be-folded regions, which project sideways in the form of the square tube of the inner wrapper, according to predetermined steps of folding procedure. As this is done, the regions of the inner wrapper are folded. After one step of folding procedure is finished, the folding claws are quickly retracted to be ready for the next folding cycle. When the cigarette bundle is in the form of tiers of bales, for example, the to-be-folded regions of the inner wrapper that are located at opposite sides in the width direction of the cigarette bundle are referred to as lug portions. When each of the lug portions are folded, a pair of side flaps that are opposite to each other in the thickness direction of the cigarette bundle are formed, respectively. As this is done, the folding claws for folding the lug portions laterally advance toward the cigarette bundle, fold the lug portions along the end faces (aggregation of cigarette end faces or filter end faces) of the cigarette bundle, and then quickly retract from the end faces. When the aforesaid side flaps are folded in succession, thereafter, the inside packaging of the cigarette bundle is completed.

In the folding step described above, however, the lug portions are freed during the time interval that elapses from the instant that the lug portions of the inner wrapper are folded until the side flaps are folded, because of the retracting of the folding claws. In some cases, therefore, the lug portions are then apt to return to the state before the folding operation. If the extent of this return is extremely large, the side flaps that are once formed also get out of shape. Thereafter, neither the side flaps nor the lug poritons can be regularly folded, thus resulting in failure in inner wrapper folding.

Recently, moreover, recyclable materials have started to be used as packaging materials for cigarettes in consideration of environmental load. That is, there are increasing opportunities of using high-elasticity materials, such as deposited metal film, in place of conventional high-plasticity materials based on metal foil. If the deposited metal film, which is poor in plasticity, is used as an inner wrapper, in particular, the deposited metal film itself can hardly be expected naturally to maintain its folded state in the aforesaid folding process. If the deposited metal film is used as the inner wrapper, therefore, the inner wrapper folding operation in the cigarette packaging machine is liable to become more unstable.

In some cases, on the other hand, the wrapper folding operation may become unstable due to mechanical factors of the packaging machine, as well as to the characteristic factors of the packaging material. The fold wrapping of a product as well as the cigarette bundle comprises, for example, a step of folding a wrapper around a product and then folding end-flaps of the wrapper on the product, a step of folding lug portions of the wrapper that are caused to project sideways from the product, thereby forming a pair of side flaps at each side, and a step of successively folding the pair of side flaps.

According to a folding manner that is frequently used in the step of side flap folding, among other manners, the product is transported along folding lines of the side flaps, for example, and the side flaps are guided in being folded along folding guides in this process of transportation. Each folding guide has a guide surface that guides a side face of the product, and a folding edge is formed on the extreme end of the guide surface. The folding edge extends diagonally across the path of transportation of the product. As the product is transported, the side flap is guided by the folding edge and folded onto the side face of the product. If the product is transported sideways, for example, the pair of side flaps, upper and lower, are formed beside the product as the lug portions of the wrapper are folded. When the upper side flap is guided in being folded by means of the folding guide, thereafter, a difference in level corresponding to the length of projection of the upper side flap is secured between the starting and terminal ends of the folding edge. The starting end is located slightly above the upper side flap. As the product is transported, therefore, the upper side flap engages the folding edge and is folded down along the folding edge during its passage. When the upper side flap passes the terminal end of the folding edge, the upper side flap is held between the product and the guide surface, whereupon folding the upper side flap is finished.

According to the folding method described above, the lateral force of transportation is supposed to be converted into a downward force of depression when the upper side flap of the wrapper is slid relatively to the folding edge as the product is transported. This force of depression can cause the upper side flap to be laid over the sided face of the product so that the upper side flap can be brought gradually into intimate contact with the side face of the product, its proximal end portion first.

If the coefficient of friction between the wrapper and the folding edge is extremely high, for example, however, the folding edge is subjected to an excessive resistance opposite to the direction of movement of the wrapper, so that the side flap is then dragged heavily. If the wrapper lacks in rigidity depending on its material, the force received from the folding edge may be concentrated only on a part of the side flap and fail to be effectively transmitted as a force to bend the side flap in some cases. In these circumstances, it is hard to fold the side flap accurately along its regular crease.

With the recent improvement of the production capacity of cigarette manufacturing machines, moreover, the cigarette packaging machine, for example, has started to require shorter packaging cycles. Thus, a step of wrapping a cigarette bundle in an inner wrapper, for example, requires development of technique for folding side flaps while transporting the cigarette bundle at a higher speed in a shorter interval of transportation.

DISCLOSURE OF THE INVENTION

The object of the present invention is to provide a wrapper folding apparatus of a packaging machine, capable of accurately folding a wrapper with stability without regard to its material in fold wrapping of various packaged products including cigarette bundles.

A wrapper folding apparatus of a packaging machine according to the present invention is realized by the use of a wrapper folding turret. The folding turret has an inlet position and an outlet position for a cigarette bundle to be wrapped. A pocket is supplied with the cigarette bundle and an inner wrapper in the inlet position. During this supply, the inner wrapper is folded around the periphery of the cigarette bundle. The pocket of the folding turret is provided with first lug folding guides. The lug folding guides folds one-sided lug portions of the inner wrapper, which are formed by the peripheral folding of the inner wrapper, as the inner wrapper is peripherally folded, and maintains the folded state of the one-sided lug portion until the outlet position is reached.

On the other hand, end flaps of the inner wrapper are folded between the inlet and outlet positions of the folding turret, whereupon the other-sided lug portions paired with the one-sided lug portions, respectively are formed. The folded state of the end flaps is maintained until the outlet position is reached. When the cigarette bundle is partially wrapped in the inner wrapper as the end flaps are folded, the resulting semifinished inner pack is discharged from the pocket in the outlet position of the folding turret.

Second lug folding guides for folding the other-sided lug portions as the semifinished inner pack is discharged are located in the outlet position of the folding turret. As the other-sided lug portions are folded in this manner, a pair of side flaps are formed with both the one-sided and the other-sided lug portions between them, respectively.

Side flap folding guides are located immediately on the lower-stream side of the second lug folding guides as viewed in the direction of discharge of the semifinished inner pack. The guides fold one of the corresponding pair of side flaps after the other-sided lug portions are folded.

A transportation turret is located close to the folding turret. The semifinished inner pack discharged from the pocket of the folding turret is then pushed into a pocket of the transportation turret. The pocket of the transportation turret is provided with folding edges. As the semifinished inner pack is pushed in, the folding edges fold the other side flaps respectively.

When the one-sided lug portions are folded as the inner wrapper is peripherally folded, according to the inner wrapper folding apparatus described above, the one-sided lug portions are kept folded by means of the first lug folding guides until one of the side flaps is folded. When the other-sided lug portions are folded, the one side flap is folded without delay, so that neither of the one-sided and the other-sided lug portions can be freed after they are folded.

Thus, the wrapper folding apparatus of the packaging machine of the present invention can always steadily fold the wrapper without regard to the quality of the material that is used as the inner wrapper for the cigarette bundle. Since the inner pack is formed in an accurately folded configuration, moreover, a satisfactory quality can be secured for a cigarette pack to be completed afterward.

Preferably, each of the first lug folding guides may include a stationary guide and a holding guide. The stationary guide is fixed in the inlet position of the folding turret. As the folding turret rotates, on the other hand, the holding guide can move together with the pocket. Further, the stationary guide guides the one-sided lug portion in being folded as the inner wrapper is peripherally folded. As this is done, the holding guide adjoins the stationary guide in the inlet position. When the cigarette bundle is fed into the pocket, the outer surface of the cigarette bundle can be held by means of the one-sided lug portion that is folded. If the stationary guide and the holding guide are thus formed separately, an existing packaging machine can be modified with ease.

Although the wrapper folding apparatus described above is suited for the inside packaging of the cigarette bundle, there may alternatively be provided the following wrapper folding apparatus that is suited for the inside packaging or external wrapping of various products.

More specifically, the wrapper folding apparatus of a packaging machine of the present embodiment comprises lug folding means, transportation means, and side flap folding guides. The lug folding means folds regions paired in the width direction of a product, out of to-be-folded portions of a wrapper that are formed by subjecting the wrapper to peripheral folding and end-flap folding around the product, thereby forming a pair of side flaps on the wrapper respectively. The transportation means transports the product along a folding line of the side flap with the side flaps formed in this manner. The side flap folding guides guide the one side flap in being folded as the product is transported. Each of the side flap folding guides has a curved guide surface. The curved guide surface comes into surface contact with the one side flap to be folded during the passage of the side flap, so that the side flap is subjected to a folding surface pressure in the direction of rolling around the folding line in the surface contact area.

According to the wrapper folding apparatus provided with the side flap folding guides described above, a force in the direction of transportation is converted into a folding surface pressure when the side flap slides with respect to the curved guide surface as the product is transported. The folding surface pressure converts linear movement of the side flap into circular motion around the folding line, so that the entire surface contact area of the curved guide surface can efficiently guide the side flap in being folded.

Thus, the wrapper folding apparatus of the present invention can realize efficient side flap folding for various wrappers and complete stable accurate fold wrapping. Since it is never influenced by the coefficient of friction between the wrapper and the guide or the rigidity of the wrapper, a packaging machine with high versatility can be provided.

The curved guide surface is realized including a curved surface that is obtained by a geometrical method, and this curved surface is defined by a trace of a given straight line. More specifically, the curved surface is defined by a trace that is formed when a straight line, extending at an acute angle to the folding line within a plane along the one side flap not folded yet and on the upper-stream side as viewed in the direction of transportation of the product from the folding line, is rotated around the folding line in the folding direction of the one side flap as the straight line is moved in the direction of transportation. Preferably, the straight line is rotated for an angle at which the side flap is to be folded.

The trace of the straight line described above forms a fixed slope with respect to the folding line in an arbitrary infinitesimal portion around the folding line. This slope is composed of an angle between the straight line and the folding line, a moving speed component of the straight line in the direction of transportation of the product, and a rotational speed component around the folding line. Since the straight line has a downward gradient toward the folding line as viewed in the direction of transportation of the product, the aforesaid slope can convert the force in the direction of transportation of the product along the inclination of the straight line, thereby subjecting the side flap to a centripetal force toward the folding line.

Preferably, the angle formed between the straight line and the folding line is set within the range of 10° to 80°. The magnitude of centripetal force varies depending on this angle.

If the shape of the curved guide surface is defined geometrically, the shape can be easily changed according to various conditions, such as the speed of product transportation, wrapper folding travel, folding angle, etc.

Each of the side flap folding guides further has friction reducing means for lowering the coefficient of friction between the curved guide surface and the wrapper. In this case, the guide can be applied to folding of a wrapper with an extremely high coefficient of friction with the curved guide surface, and can more easily meet conditions related to the type of the wrapper, speed of product transportation, folding travel, folding angle, etc.

BEST MODE FOR CARRYING OUT THE INVENTION

Figure 1:
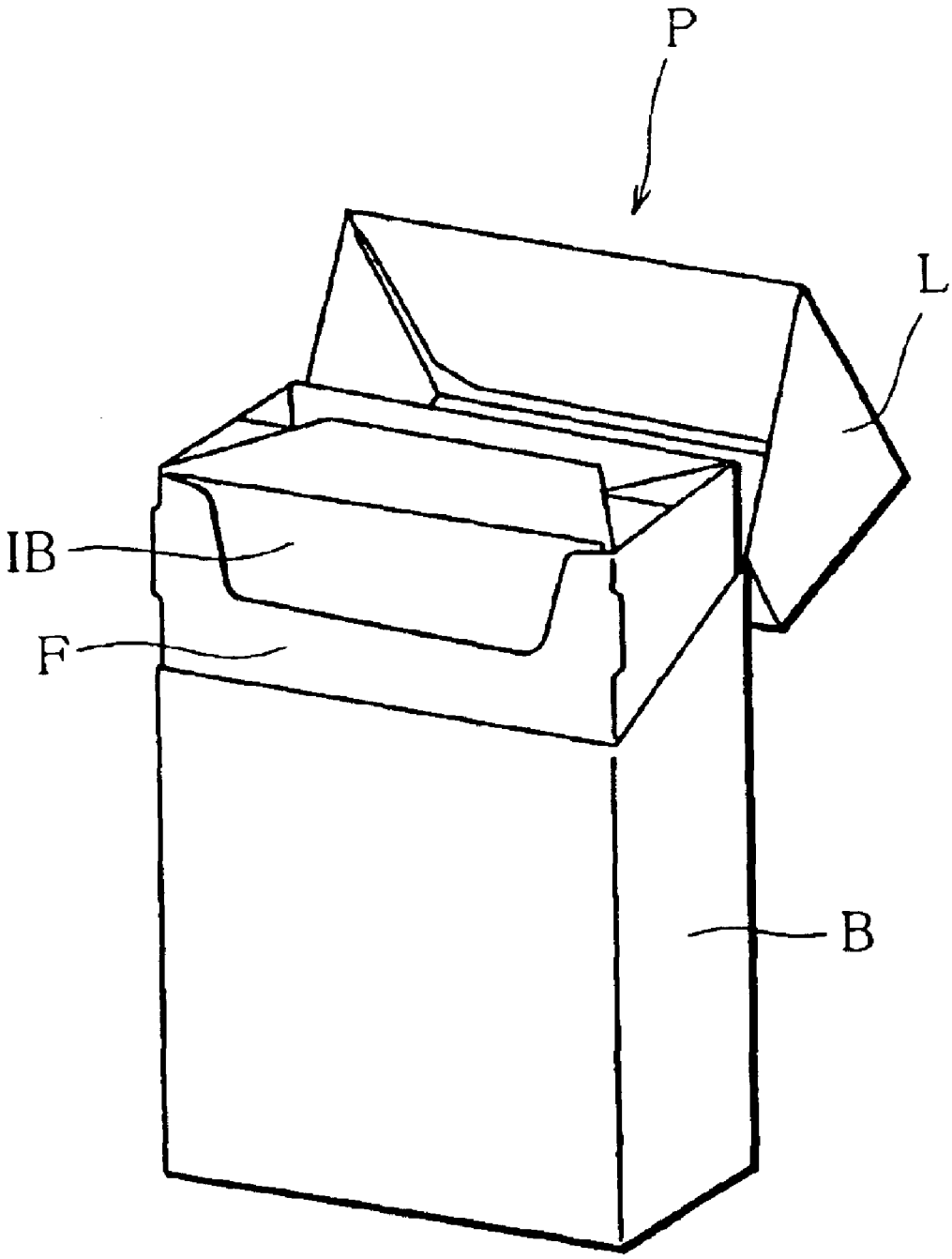
FIG. 1 is a perspective view of a hinge-lidded package for filter cigarettes.

As shown in FIG. 1, filter cigarettes are packaged in a hinge-lidded package P in the form of a box, for example. The hinge-lidded package P for use as an outer package for the filter cigarettes comprises an open-topped pack body B. The pack body B can store an inner pack of filter cigarettes therein. A lid L is coupled to the rear wall (not shown) of the pack body B by means of a self-hinge. The top opening of the pack body B can be opened or closed by rotating the lid L around the self-hinge. Further, a front opening edge of the pack body B is formed by an inner frame F. When the lid L is shut down, the lid L is put on the inner frame F. The pack body B is stored with, for example, twenty filter cigarettes in a bundle. This bundle of filter cigarettes is wrapped in an inner wrapper and forms the inner pack IB. When the lid L is lifted opened as illustrated, the inner pack IB is partially exposed.

Figure 2:
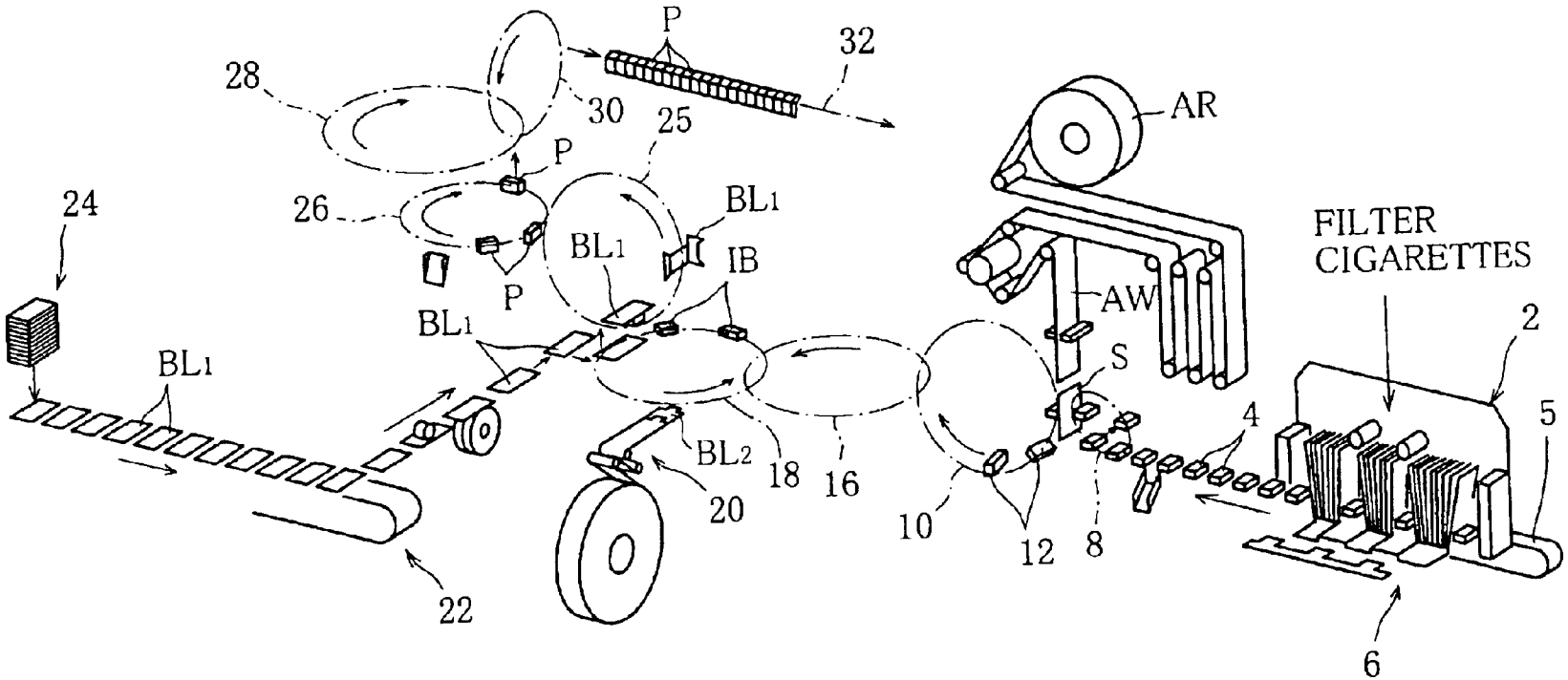
FIG. 2 is a schematic view of a packaging machine for manufacturing the hinge-lidded package of FIG. 1.

The package of FIG. 1 is manufactured by means of a packaging machine shown in FIG. 2, for example. The pack body B and the lid L of the hinge-lidded package P can be formed from one blank BL1. Further, the inner frame F is formed from a dedicated blank BL2. The blank BL2 and the blank BL1 are supplied to a packaging line via separate paths. In FIG. 1, a wrapper folding apparatus of the present invention is located in a folding section for the inner wrapper. First, the general configuration of the packaging machine will be described in brief.

The packaging machine is provided with a hopper 2 for filter cigarettes. The filter cigarettes having undergone a quality inspection are continuously supplied from a filter attachment (not shown) into the hopper 2. A pocket conveyor 5 having a large number of mouthpieces 4 is located near the hopper 2. The pocket conveyor 5 extends from the hopper 2 toward the inner wrapper folding section. A cigarette filling mechanism 6 is provided under the hopper 2. The filling mechanism 6 thrusts out the twenty filter cigarettes in three tiers of bales through the outlet of the hopper 2. The thrust filter cigarettes are filled into each mouthpiece 4, whereupon they form a cigarette bundle. The cigarette bundle, along with the mouthpiece 4, is transported and fed toward the aforesaid folding section.

That part of the packaging line of the packaging machine which extends beyond the pocket conveyor 5 is defined by a large number of wheel train indicated by dashed lines in FIG. 1. The mouthpiece 4 is transported to a vertical first wheel 8, and the first wheel 8 receives the cigarette bundle from the mouthpiece 4. As it rotates intermittently, the first wheel 8 transports the received cigarette bundle toward a subsequent vertical second wheel 10.

The second wheel 10 is formed of a folding turret for aluminized sheets S. The second wheel 10 includes a plurality of pockets 12 that are arranged at equal spaces in the circumferential direction of the wheel 10. The second wheel 10 centers the aforesaid inner wrapper folding section.

The aluminized sheets S are obtained by cutting an aluminized film web AW that is delivered from a web roll AR into given lengths, and are successively fed to the region between the first wheel 8 and the second wheel 10 by means of a suction conveyor (not shown). Another web roll (not shown) of the same specifications is located near the web roll AR, and this web roll is currently on standby. If the remainder of the working web roll AR becomes insufficient, thereafter, a new aluminized film web is drawn out from the roll on standby and automatically connected to the working aluminized film web AW.

A horizontal third wheel 16 adjoins the second wheel 10 on the side opposite from the first wheel 8. The third wheel 16 successively receives cigarette bundles from the second wheel 10 into one of pockets thereof. As the wheel 16 rotates intermittently, the wheel 16 transports the inner pack IB of each cigarette bundle.

Further, a fourth wheel 18, also horizontal, adjoins the second wheel 16 on the side opposite from the second wheel 10. The fourth wheel 18 is situated below the third wheel 16, and pockets of the wheel 18 successively overlap the pocket of the third wheel 16 as the wheels 16 and 18 rotate intermittently.

As the fourth wheel 18 rotates intermittently, the wheel 18 is supplied with the aforesaid blanks BL2 from one blank supply path 20, and transports inner frames, which are formed by folding the blanks BL2 toward the third wheel 16.

When the pocket of the fourth wheel 18 and the pocket of the third wheel 16 vertically overlap one another, the aforesaid inner pack IB in the pocket of the third wheel 16 are pushed individually into the pocket of the fourth wheel 18. In these pockets, the inner pack IB is combined with the inner frame and bonded together. Thereafter, the inner pack IB with the inner frame is transported as the fourth wheel 18 rotates intermittently.

On the other hand, the fourth wheel 18 is supplied with the aforesaid blanks BL1 from the other blank supply path 22, and the blank BL1 is bonded individually to the upper surface of the inner pack IB with the inner frame between them. As seen from FIG. 2, the blank supply path 22 connects a hopper 24 and the fourth wheel 18. The blanks BL1 that are taken out one after another from the hopper 24 are transported along the path 22 toward the fourth wheel 18.

A vertical fifth wheel 25 is located right over the position of supply of each blank BL1 as viewed in the circumferential direction of the fourth wheel 18. The fifth wheel 25 receives the inner pack IB, having the blank BL1 bonded thereto, into one of pockets thereof. As this is done, the inside wall portions of the blank BL1 are folded simultaneously on the inner pack. As the fifth wheel 25 then rotates intermittently, the blank BL1 is further folded in succession, whereupon a hinge-lidded package P is completed.

Thereafter, the hinge-lidded package P is transferred to a horizontal seventh wheel 28 via a horizontal sixth wheel 26 that adjoins the fifth wheel 25. As the seventh wheel 28 rotates intermittently, the wheel 28 transports the hinge-lidded package P. In this process of transportation, glued portions of the blanks BL1 and BL2 are dried. Thereafter, the hinge-lidded package P is delivered through a vertical eighth wheel 30 to a package delivery line 32. The package delivery line 32 successively feeds the hinge-lidded packages P toward a film-wrapping machine (not shown), and the film-wrapping machine wraps each hinge-lidded package P in a film sheet.

Figure 3:
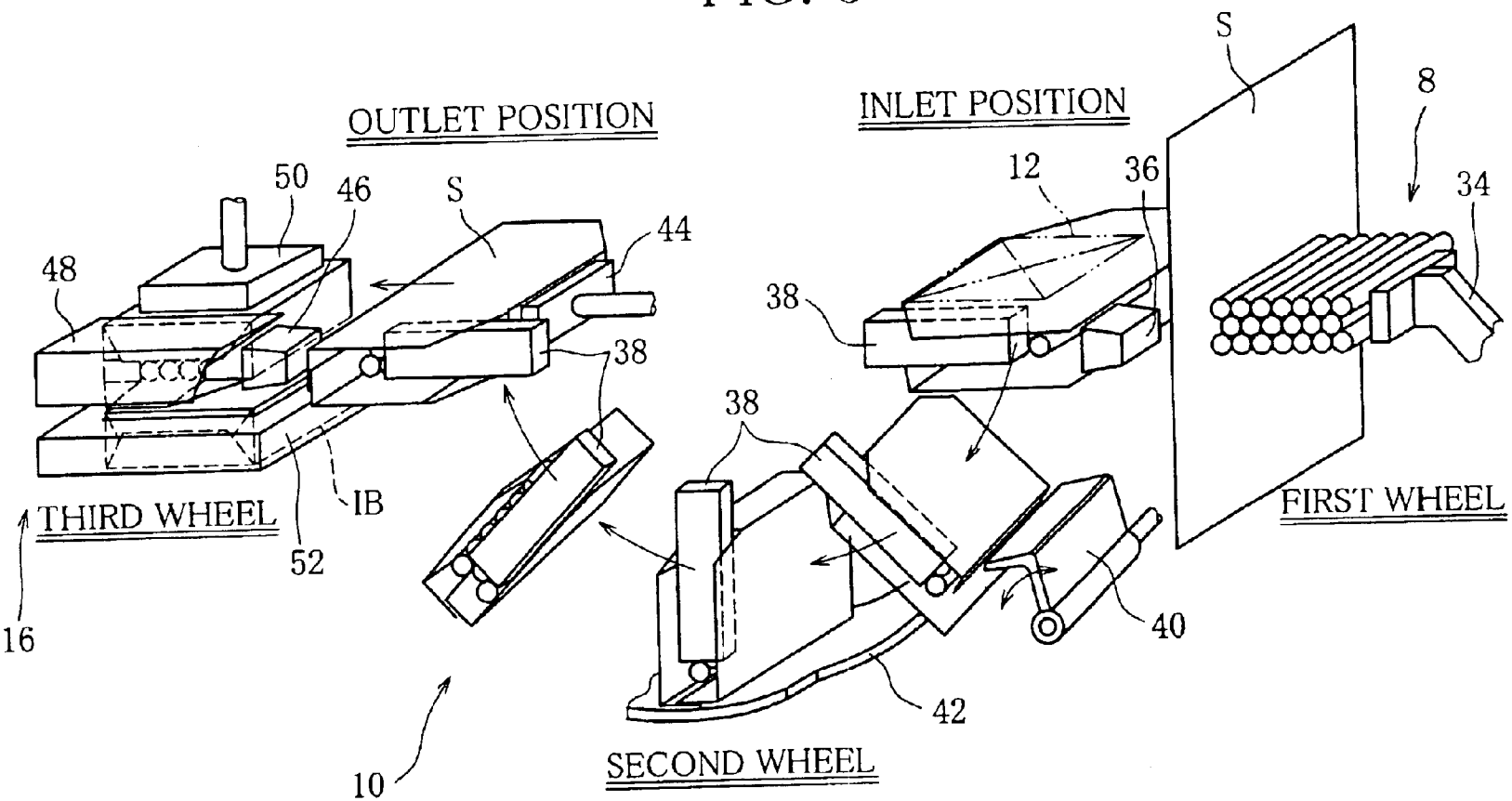
FIG. 3 is a perspective view specifically showing a configuration of a folding section of the packaging machine of FIG. 2.

FIG. 3 specifically shows the inner wrapper folding section of the packaging machine. The second wheel 10 or the folding turret centers the inner wrapper folding section.

The inlet position of the folding turret is located between the second wheel 10 and the first wheel 8. In this inlet position, the empty pocket 12 of the second wheel 10 is supplied with the cigarette bundle and the aluminized sheet S. The cigarette bundle is pushed out from the first wheel 8 by means of a pusher 34, and is plunged into the pocket 12 of the second wheel 10 in the inlet position. As this is done, the aluminized sheet S is folded in the shape of a U along the periphery of the cigarette bundle and, along with the cigarette bundle, is received in the pocket 12.

Primary lug folding guides 36 are fixed in the inlet position of the second wheel 10. The primary lug folding guides 36 are located just short of the pocket 12 as viewed in the plunging direction of the cigarette bundle on the opposite sides of the pocket 12, respectively. On the other hand, each individual pocket 12 of the second wheel 10 is provided with a pair of holding guides 38 that extend along the opposite sides of the pocket 12. These holding guides 38 are ranged in the plunging direction of the cigarette bundle with respect to the primary lug folding guides 36 in the aforesaid inlet position, respectively.

When the aluminized sheet S is folded in the aforesaid manner, primary lug portions are formed individually on the opposite sides of the cigarette bundle. At the same time, the primary lug folding guides 36 guide the primary lug portions in being folded along the opposite end faces of the cigarette bundle. The primary lug portions that are folded in this manner are located inside the second wheel 10 as viewed in its diametrical direction thereof. When end flaps of the sheet S are folded thereafter, secondary lug portions are formed outside the second wheel 10 as viewed in its diametrical direction thereof. The primary and secondary lug portions should be formed in pairs beside the cigarette bundle.

As the cigarette bundle is plunged further, the primary lug portions that are folded by means of the primary lug folding guides 36 are held between the holding guides 38 and the cigarette bundle. Thereafter, the holding guides 38 can hold the opposite end faces of the cigarette bundle with the primary lug portions of the aluminized sheet S between them. Only one of the primary lug folding guides 36 of each pocket 12 and one of the holding guides 38 are shown in FIG. 3, and the other primary lug folding guide 36 and the other holding guide 38 are not.

When the cigarette bundle is fully plunged into the pocket 12, the pusher 34 retracts from the second wheel 10, and the second wheel 10 rotates intermittently in the clockwise direction of FIG. 3. As the second wheel 10 rotates intermittently, moreover, another empty pocket 12 moves to the inlet position.

A movable end-flap folding guide 40 and a stationary guide plate 42 are provided outside the second wheel 10. The end-flap folding guide 40 rotates toward the outer peripheral surface of the second wheel 10, thereby folding one of the end flaps along the periphery of the cigarette bundle. When the second wheel 10 then rotates, the other end flap is guided and folded by means of the guide plate 42, whereupon folding the end flaps of the aluminized sheet S is completed. The inner peripheral surface of the guide plate 42 extends along the outer periphery of the second wheel 10 toward the outlet position. The guide plate 42 serves to keep the end flaps folded. When the end flaps of the aluminized sheet S are folded, as mentioned before, the secondary lug portions are formed individually on the opposite sides of the cigarette bundle and are located outside second wheel 10 as viewed in its diametrical direction thereof. The way of folding the secondary lug portions will be mentioned later.

The primary lug portions that are already folded are kept in its folded state by means of the holding guides 38. The holding guides 38 can maintain the folded state of the primary lug portions as the second wheel 10 rotates from the inlet position to the outlet position.

The outlet position of the second wheel 10 is opposite to the inlet position with respect to its center of rotation. A discharge pusher 44 is located in the outlet position. In this outlet position, the pusher 44 pushes out the cigarette bundle together with the aluminized sheet S from the pocket 12. As this is done, the cigarette bundle is partially wrapped in the sheet S. When the cigarette bundle is discharged from the pocket 12, therefore, it is in the form of a semifinished inner pack.

Further, secondary lug folding guides 46 for use as second lug folding guides are provided in the outlet position of the second wheel 10. These secondary guides 46 are also located on the opposite sides of the pocket 12, respectively. The secondary lug folding guides 46 are positioned just ahead of the pocket 12 as viewed in the direction of discharged of the semifinished inner pack. Side flap folding guides 48 are arranged immediately on the lower-stream side of the secondary lug folding guides 46, individually. Only one of the secondary lug folding guides 46 and one of the side flap folding guides 48 are shown in FIG. 3.

When the discharge pusher 44 discharges the semifinished inner pack from the pocket 12 of the second wheel 10, the secondary lug folding guides 46 guide the secondary lugs on the end-flap side in being folded. As the secondary lug portions are folded, moreover, a pair of side flaps, upper and lower, are formed individually on the opposite sides of the cigarette bundle, respectively. After the secondary lug portions are folded, the side flap folding guides 48 fold the upper side flap and put it on the primary and secondary lug portions that are already folded.

When the discharge of the semifinished inner pack is completed, the folded upper side flap and both the lug portions are sandwiched between the side flap folding guides 48 and the side faces of the cigarette bundle. The side flap folding guides 48 can cause the upper side flap and the lug portions to hold the side faces of the cigarette bundle, thereby maintaining the folded state. The lower side flap that is not folded yet is situated right under the side flap folding guides 48 and projects sideways from the cigarette bundle.

When the discharge of the semifinished inner pack from the pocket 12 of the second wheel 10 is completed as described above, the pack is located upwardly a pocket 52 of the third wheel 16 so as to be superposed on the pocket 52. In this position, moreover, a stuffing pusher 50 is located over the pocket 52. The pusher 50 can push the discharged semifinished inner pack into the pocket 52 of the third wheel 16.

The pocket 52 is formed of a rectangular frame, which has a shape such that the pocket 52 can receive the cigarette bundle only in the form of a completed inner pack. When the cigarette bundle in the form of the semifinished inner pack is pushed into the pocket 52, therefore, the lower side flap is guided in being folded by means of the upper edge of the inner peripheral wall of the pocket 52. When the cigarette bundle is fully pushed into the pocket 52, folding the lower side flap is finished, whereupon the inner pack IB of the cigarette bundle is completed.

As the aluminized sheet S is folded in the folding section of the packaging machine in the aforesaid manner, none of the lug portions of the aluminized sheet S are free in the middle of the operation. The material of the inner wrapper is not limited to aluminized film, and may alternatively be paper laminated with metal foil, such as aluminum foil.

Although the primary lug folding guides 36 and the holding guides 38 in the inlet position of the second wheel 10 are formed separately according to the embodiment described above, they may be formed integrally with one another. In this case, each pocket 12 is provided with members, each of the members integrally including a lug folding guide and a holding guide for the aluminized sheet S.

The wrapper folding apparatus of the present invention may be suitably modified to match the form of the cigarette packaging machine to which the apparatus is installed. More specifically, the wrapper folding apparatus of the invention is intended to keep the folded state of the lug portions formed by folding the inner wrapper (aluminized sheet or aluminum foil sheet) until the pair of side flaps formed by the folding are lapped on the lug portions. Thus, specific means for fulfilling the aforesaid function is not limited to the form described above.

The side flap folding guides of the wrapper folding apparatus of the present invention will now be described in detail. The wrapper folding apparatus with the side flap folding guides described below is applicable to packaging machines for various products, as well as to the cigarette packaging machine. For ease of illustration, however, the wrapper folding apparatus is supposed to be applied to the cigarette packaging machine shown in FIG. 1 in the description to follow.

Figure 4:
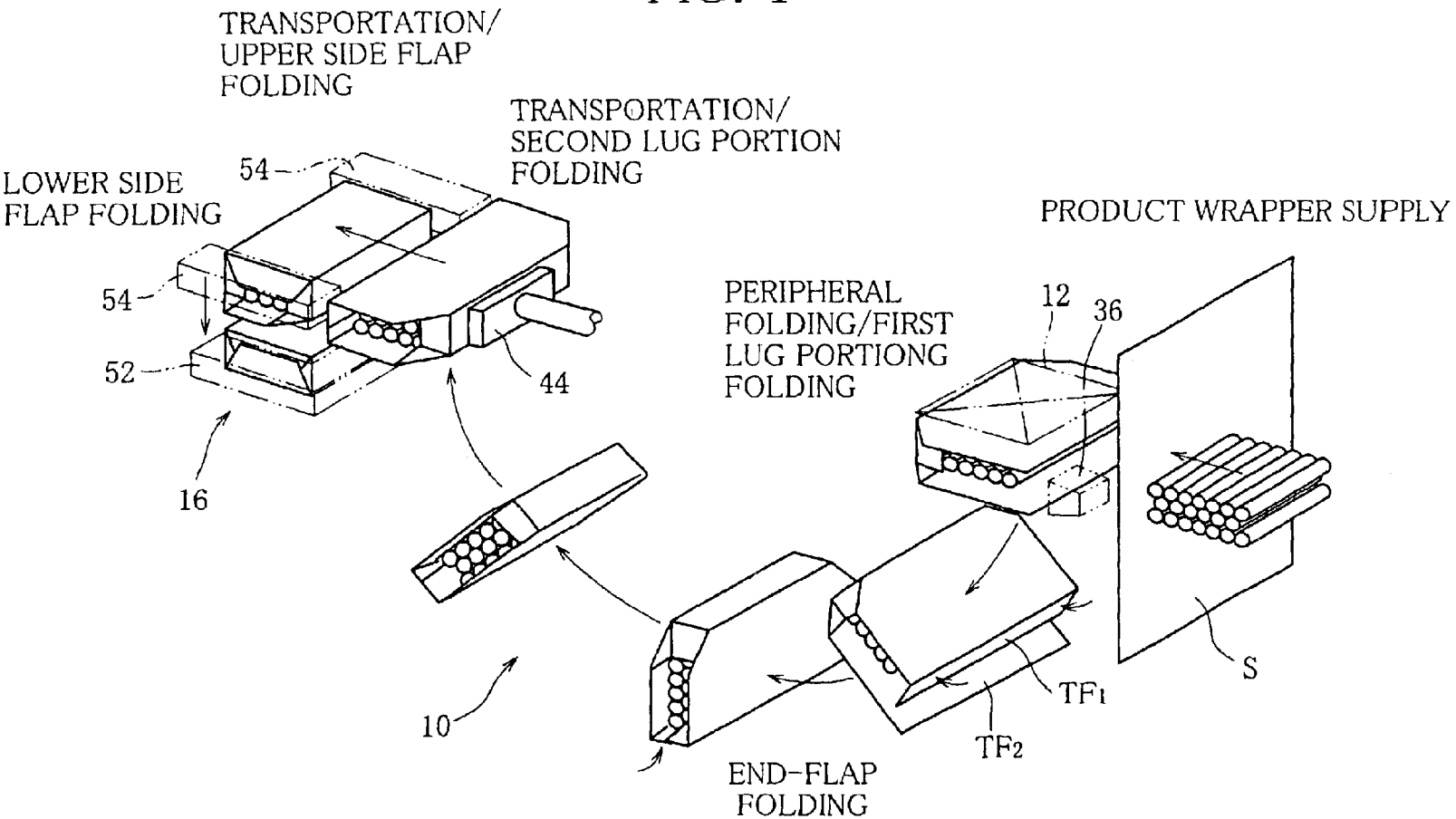
FIG. 4 is a perspective view for illustrating steps of operation in the folding section of the packaging machine of FIG. 2.

FIG. 4, like FIG. 3, shows the inner wrapper folding section. However, the pusher 34, holding guides 38, end-flap folding guide 40, stationary guide plate 42, etc. shown in FIG. 3 is not shown in FIG. 4. In FIG. 4, moreover, the secondary lug folding guide 46 and the side flap folding guide 48 are represented by one folding guide set 54. The cigarette bundle in the second wheel 10 is internally wrapped according to the same steps as aforementioned.

Figure 5:
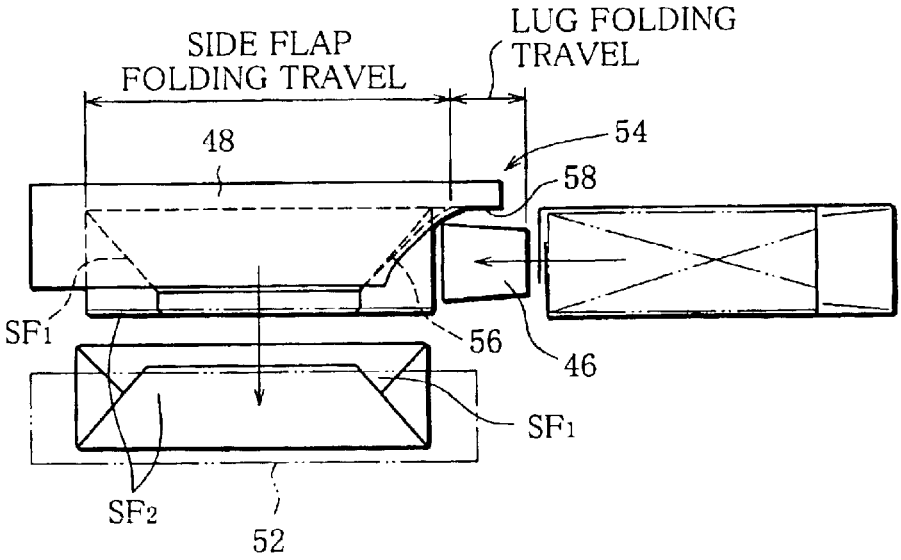
FIG. 5 is a side view specifically showing a folding guide set.

FIG. 5 specifically shows the folding guide set 54. As shown in this drawing, the folding guide set 54 includes the secondary lug folding guide 46 and the side flap folding guide 48. The secondary lug folding guide 46 is located on the upper-stream side of the cigarette bundle as viewed in the discharge direction of the cigarette bundle, and the side flap folding guide 48 is located immediately on the lower-stream side of the secondary lug folding guide 46 so as to adjoin it. Only one folding guide set 54 is shown FIG. 5.

When the cigarette bundle is discharged horizontally along the folding guide set 54 by the agency of the aforesaid discharge pusher 44, the secondary lug folding guide 46 first guides a region of the folded end flaps of the aluminized sheet S, that is, a secondary lug portion, in being folded. This region is only tucked in the direction opposite to the discharge direction of the cigarette bundle, so that the folding operation thereof can be completed when a relatively short distance (lug folding travel in FIG. 5) is covered. This folding operation forms a pair of side flaps, upper and lower, on each of the opposite sides of the cigarette bundle. All the upper and lower side flaps (not shown in FIG. 5) extend horizontally and sideways from the cigarette bundle before they are folded.

As the cigarette bundle is further discharged, the cigarette bundle is moved in the side flap folding travel shown in FIG. 5. As this is done, the side flap folding guides 48 guide upper side flaps SF1, out of the upper and lower side flaps, in being folded.

Figure 6:
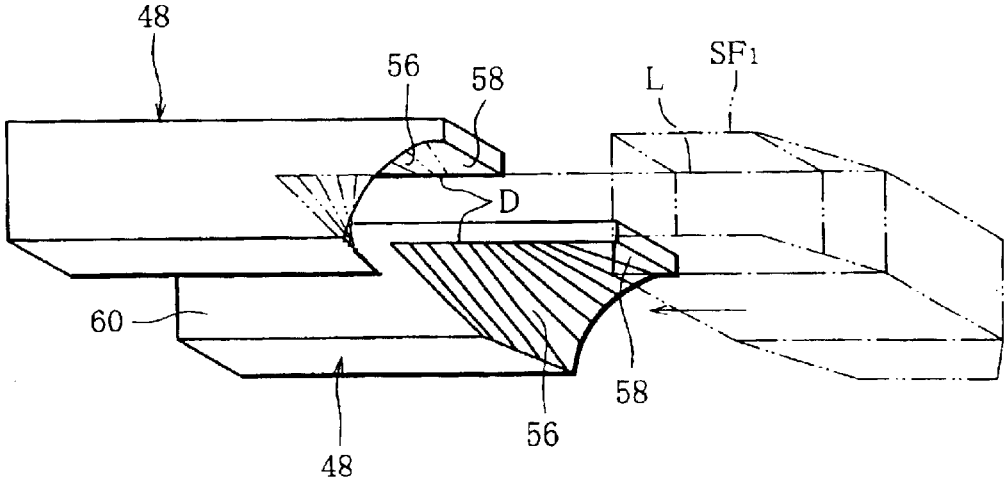
FIG. 6 is a perspective view specifically showing a configuration of side flap folding guides.

FIG. 6 specifically shows the side flap folding guides 48 described above. Each side flap folding guide 48 is formed having a curved guide surface 56 that is hatched in the drawing. Further, a raked plate 58 is formed on one end of each side flap folding guide 48 on the upper-stream side as viewed in the discharge direction of the cigarette bundle. This raked plate 58 is continuous with the starting end of the curved guide surface 56, and extends horizontally toward the upper-stream side in the discharge direction the cigarette bundle. The opposite side flap folding guides 48 form a symmetrical configuration, and individually have vertical guide surfaces 60 facing to each other. Each vertical guide surface 60 extends in the discharge direction of the cigarette bundle from the terminal end of the aforesaid curved guide surface 56.

When the cigarette bundle in the form of the semifinished inner pack is moved between the opposite side flap folding guides 48, the respective raked plates 58 of the side flap folding guides 48 are situated slightly above the upper side flaps SF1. As the semifinished inner pack is moved, therefore, the upper side flaps SF1 are guided along the respective lower surfaces of the raked plates 58 and then led to the curved guide surfaces 56. When the semifinished inner pack is moved, moreover, a boundary D between each curved guide surface 56 and each vertical guide surface 60 in the discharge direction is alined with a folding line L of the upper side flap SF1. The respective extreme ends of the raked plates 58 may be chamfered so as to have an arcuate profile in order to enable the upper side flaps SF1 to be smoothly guided to the respective lower surfaces of the raked plates 58 as the upper side flaps SF1 approach the raked plates 58.

Figure 7:
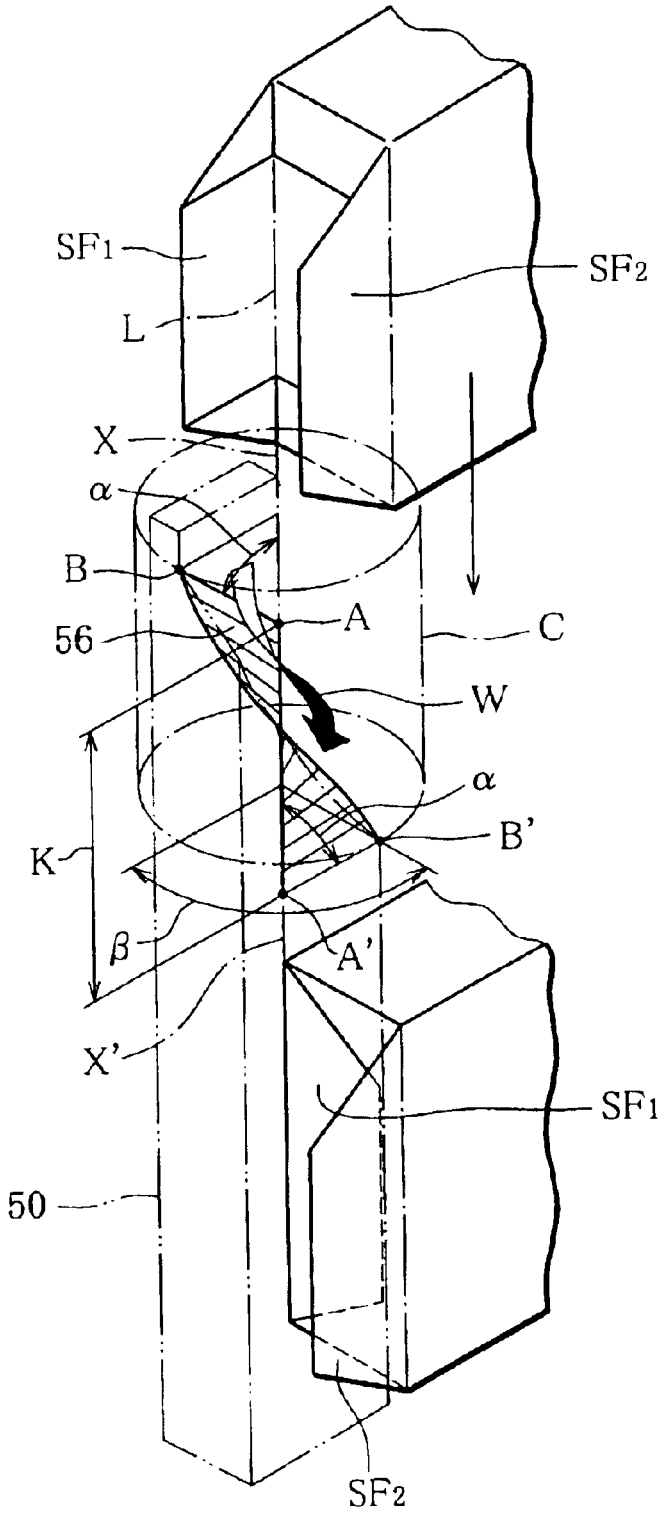
FIG. 7 is a perspective view for geometrically illustrating the shape of a curved guide surface.

FIG. 7 geometrically shows the curved guide surface 56 of each side flap folding guide 48. The following is a geometrical description of a specific shape of the curved guide surface 56.

First, an imaginary axis X–X' is aligned with the folding line L of each upper side flap SF1 as viewed in the moving direction of the cigarette bundle (semifinished inner pack), and a straight line A–B is defined extending from an arbitrary point A on the axis X–X' to a point B in the direction opposite to the moving direction, that is, at a given opening angle $\alpha$ (e.g., 45°) on the upper-stream side. Preferably, the opening angle $\alpha$ is an acute angle ranging from 10° to 80°, and can be freely set within this range. The straight line A–B is supposed to be contained in a plane that extends along the upper side flap SF1 that is not folded yet.

Then, while the point A is moved in the moving direction of the cigarette bundle on the axis X–X', the point B is rotated around the axis X–X' in the direction in which the upper side flap SF1 is folded. If the point of termination of the movement of the point A is A', the point B rotates for a given angle $\beta$ and reaches a point B' while the point A moves in the interval A–A'. The angle $\beta$ is adjusted to the same value as the folding angle (e.g., 90°) of the upper side flap SF1. If an imaginary column around the axis X–X' is C, as indicated by dashed line in the drawing, the point B moves on the outer peripheral surface of the column C. Although the angle $\alpha$ between the straight line A–B and the axis X–X' undergoes no change in the example of FIG. 7, the angle $\alpha$ may be changed in the middle. While the point A moves to the point A', moreover, the ratio of the rotational angle of the point B to the moved distance may be constant or variable in the middle.

Further, the distance between the points A and A' is freely defined as a folding travel K for the upper side flap SF1. In FIG. 7, the side flap folding guide 48 is shown exaggeratedly with respect to its longitudinal direction. In the packaging machine of the present embodiment, however, the second wheel 10 and the third wheel 16 are located close to each other, so that the overall length of the folding travel is restricted structurally.

If a curved surface is delineated in accordance with a moving trace of line that covers the straight line A–B and the straight line A'–B', a fundamental shape of the curved guide surface 56 can be obtained. In the present embodiment, each side flap folding guide 48 is made of a member having a square sectional shape, the actual shape of the curved guide surface 56 involves the aforesaid curved surface.

Figure 8:
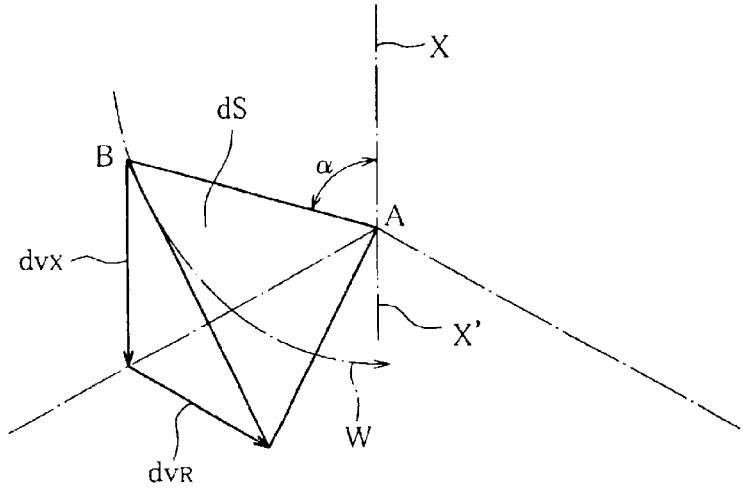
FIG. 8 is a perspective view showing an infinitesimal slope that constitutes part of the curved guide surface.

FIG. 8 specifically shows a slope dS of an arbitrary infinitesimal portion of a curved surface around the axis X–X', the curved surface being obtained by the aforementioned geometrical method. The slope dS is composed of the opening angle $\alpha$ of the straight line A–B to the axis X–X', a moving speed component dvX of the point A, and a peripheral speed component dvR of the point B.

When the upper side flap SF1 passes through the aforesaid folding operation region K as the cigarette bundle is moved, the curved guide surface 56 comes into surface contact with the upper side flap SF1. In this surface contact area, a folding surface pressure from each slope dS is applied to the upper side flap SF1. With respect to the moving direction of the cigarette bundle, the slope dS has a downward gradient in the direction of the axis X–X' or the direction of the folding line L in accordance with the opening angle $\alpha$ of the straight line A–B, so that the folding surface pressure subjects the upper side flap SF1 to a centripetal force toward the folding line L. Thus, the movement of the upper side flap SF1 toward the folding line L can be efficiently converted into circular motion around the folding line L. Since the folding surface pressure applies the centripetal force to the upper side flap SF1, moreover, the upper side flap SF1 receives a force W in the direction of rolling around the folding line L from the curved guide surface 56 as the upper side flap SF1 moves (see FIGS. 7 and 8).

When the entire upper side flap SF1 passes through the folding travel K, folding the upper side flap SF1 is finished, whereupon the upper side flap SF1 is lapped on the already folded portions. Further, the folded portions and the upper side flap SF1 are sandwiched between the vertical guide surface 60 of the side flap folding guide 48 and the side face of the cigarette bundle.

According to the wrapper folding apparatus of the present embodiment, as described above, the cigarette bundle can be discharged from the second wheel 10, and the upper side flap SF1 can be folded in a short interval of transportation for the delivery to the third wheel 16 in the next stage. Since the upper side flap SF1 is efficiently subjected to the folding surface pressure as the flap SF1 is guided along the curved guide surface 56, moreover, it can be folding accurately.

Figure 9:
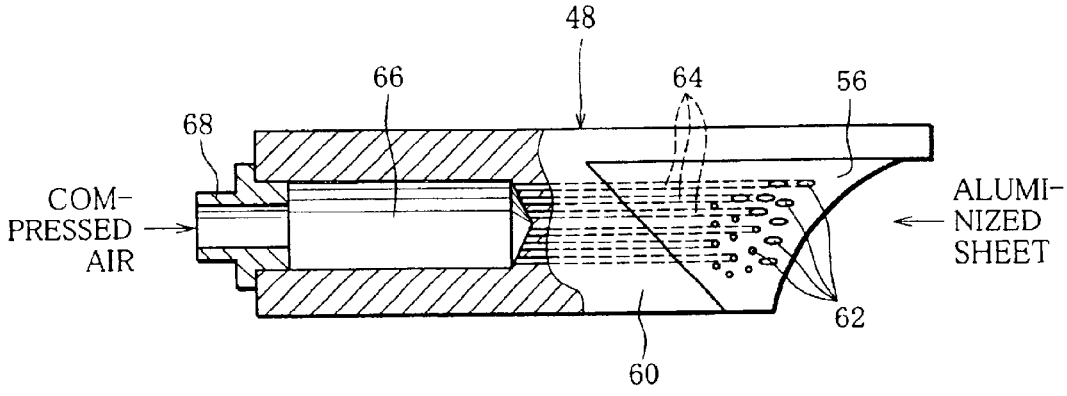
FIG. 9 is a partial sectional view showing equipment for reducing friction between the curved guide surface and a wrapper.

FIG. 9 shows additional equipment for the curved guide surface 56 of each side flap folding guide 48. As shown in the drawing, a large number of air jets 62 are formed in the curved guide surface 56. On the other hand, a large number of air passages 64 are formed in the side flap folding guide 48. One end of each air passage 64 communicate with its corresponding air jet 62 on the curved guide surface 56. Further, the side flap folding guide 48 is formed having an air supply chamber 66 that extends in the guide 48 from its end face opposite to the curved guide surface 56. The air supply chamber 66 is supplied with compressed air from a pneumatic pressure source (not shown) by means of a nozzle 68.

The compressed air that is fed into the air supply chamber 66 is ejected from the air jets 62 through the air passages 64. The ejection of the compressed air from the curved guide surface 56 can reduce the coefficient of friction with the upper side flap SF1 and considerably lower its drag.

In the embodiment described above, the aluminized film is used as the inner wrapper for the cigarette bundle. However, the inner wrapper may be metal foil, paper material, or some other film material.

The equipment for friction reduction shown as an example in FIG. 9 ejects the compressed air from the curved guide surface 56. However, specific means may be modified according to the conditions of products to be wrapped and wrappers used. For example, lubricating oil, water, or impalpable powder may be supplied to the curved guide surface 56.

The specific shapes of the holding guides 38, side flap folding guides 48, first and second lug folding guides 36 and 46, etc. may be suitably modified according to the form of the packaging machine to which they are to be arranged. It is to be understood that the other illustrated forms of the guides, pushers, etc. according to the present invention are not particularly restricted, so that the forms of these members may be variously modified in carrying out the invention.

What is claimed is:

1. A wrapper folding apparatus of a packaging machine, comprising:

a packaging line along which a cigarette bundle is transported as the cigarette bundle is wrapped in an inner wrapper to form an inner pack, and in which an outer wrapper is folded around the inner pack to form a packed product of cigarettes;

a folding turret having an inlet position and an outlet position for the cigarette bundle in the middle of said packaging line and designed so that a pocket is supplied with the cigarette bundle and the inner wrapper in the inlet position in a manner such that the inner wrapper is folded around the periphery of the cigarette bundle;

first lug folding guides provided for the pocket of said folding turret and adapted to fold one-sided lug portions of the inner wrapper, formed by peripheral folding and located inside said folding turret with respect to the diametrical direction thereof, as the inner wrapper is peripherally folded, and to maintain the folded state until the outlet position is reached;

end-flap folding means for folding end flaps of the inner wrapper to form the other-sided lug portions paired with the one-sided lug portions on the inner wrapper respectively, between the inlet and outlet positions of said folding turret, and maintaining the folded state until the outlet position is reached;

discharge means for discharging a semifinished inner pack, formed of the cigarette bundle partially wrapped in the inner wrapper, from the pocket in the outlet position of said folding turret;

second lug folding guides located in the outlet position and adapted to fold the other-sided lug portions of the inner wrapper to form a pair of side flaps respectively as the semifinished inner pack is discharged;

side flap folding guides located immediately on the lower-stream side of the second lug folding guides as viewed in the direction of discharge of the semifinished inner pack and capable of folding one of the corresponding pair of side flaps after the other-sided lug portions are folded;

a transportation turret located close to said folding turret;

push means for pushing the discharged semifinished inner pack into a pocket of said transportation turret; and side flap folding edges provided for the pocket of said transportation turret and adapted to fold the other of the corresponding pair of side flaps as the semifinished inner pack is pushed in.

2. The apparatus according to claim 1, wherein each of said first lug folding guides includes a stationary guide, fixed in the inlet position of said folding turret and adapted to guide the one-sided lug portion in being folded as the inner wrapper is peripherally folded, and a holding guide adjoining the stationary guide in the direction of supply of the cigarette bundle in the inlet position and adapted to move together with the pocket as said folding turret rotates, thereby causing the one-sided lug portion to hold the outer surface of the cigarette bundle.

3. The apparatus according to claim 1, wherein each of said side flap folding guides has a curved guide surface adapted to come into surface contact with the one side flap when the side flaps passes as the semifinished inner pack is discharged, so that the one side flap is subjected to a folding surface pressure in the direction of rolling around a folding line of the one side flap in the surface contact area.

4. A wrapper folding apparatus of a packaging machine, comprising:

a packaging line along which a product to be packaged is transported with a wrapper subjected to peripheral folding and end-flap folding around the product, whereby to-be-folded portions of the wrapper projecting sideways from the product are folded in succession;

lug folding means provided in said packaging line and capable of folding lug portions paired in the width direction of the product respectively, out of the to-be-folded portions of the wrapper, and holding the folded lug portions, thereby forming a pair of side flaps opposed to each other in the thickness direction of the product respectively;

transportation means for transporting the product along a folding line of the pair of side flaps with the side flaps formed on the wrapper;

side flap folding guides adapted to guide the corresponding one of the side flaps in being folded as the product is transported; and curved guide surfaces formed on the side flap folding guides respectively and adapted to come into surface contact with the one side flap during the passage of the side flap, so that the one side flap is subjected to a folding surface pressure in the direction of rolling around the folding line in the surface contact area.

5. The apparatus according to claim 4, wherein each of said curved guide surfaces includes a curved surface obtained from a trace formed when a straight line, extending at an acute angle to the folding line within a plane along the one side flap not folded yet and on the upper-stream side as viewed in the direction of transportation of the product from the folding line, is rotated around the folding line in a folding direction of the one side flap as the straight line is moved in the direction of transportation.

6. The apparatus according to claim 5, wherein said straight line is rotated for an angle at which the one side flap is to be folded.

7. The apparatus according to claim 5, wherein the angle formed between the straight line and the folding line is set within the range of 10° to 80°.

8. The apparatus according to claim 4, wherein each of said side flap folding guides further has friction reducing means for lowering the coefficient of friction between the curved guide surface and the wrapper.

* * * * *

UNITED STATES PATENT AND TRADEMARK OFFICE

CERTIFICATE OF CORRECTION

PATENT NO. : 6,854,243 B2
APPLICATION NO. : 10/381709
DATED : February 15, 2005
INVENTOR(S) : Makoto Sendo et al.

It is certified that error appears in the above-identified patent and that said Letters Patent is hereby corrected as shown below:

Insert the following on the title of the U.S. Patent item --(30) Foreign Application Priority Data

| | | |
|---|---|---|
| September 27, 2000 | (JP) | 2000-294248 |
| September 27, 2000 | (JP) | 2000-294249 -- |

Signed and Sealed this

Nineteenth Day of June, 2007

JON W. DUDAS
*Director of the United States Patent and Trademark Office*